US006336794B1

(12) United States Patent
Kim

(10) Patent No.: US 6,336,794 B1
(45) Date of Patent: Jan. 8, 2002

(54) ROTARY COMPRESSOR ASSEMBLY WITH IMPROVED VIBRATION SUPPRESSION

(75) Inventor: Jin-Seop Kim, Seoul (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 09/698,475

(22) Filed: Oct. 30, 2000

(30) Foreign Application Priority Data

Sep. 5, 2000 (KR) ..... 00-52495

(51) Int. Cl.[7] ..... F04B 17/00
(52) U.S. Cl. ..... 417/363
(58) Field of Search ..... 417/363, 423.15, 417/902; 248/638, 618

(56) References Cited

U.S. PATENT DOCUMENTS 4,406,593 A * 9/1983 Kessler ..... 417/363
4,511,314 A * 4/1985 Fraser, Jr. et al. ..... 417/363
5,221,192 A * 6/1993 Heflin et al. ..... 417/363
5,306,121 A 4/1994 Heflin et al.
5,507,159 A * 4/1996 Cooksey ..... 62/503
5,964,579 A * 10/1999 Tang et al. ..... 417/363
6,092,284 A * 7/2000 Dreiman et al. ..... 29/890.02
6,132,183 A * 10/2000 Li et al. ..... 417/363

* cited by examiner

*Primary Examiner*—Teresa Walberg
*Assistant Examiner*—Vinod D. Patel
(74) *Attorney, Agent, or Firm*—Larson & Taylor, PLC

(57) ABSTRACT

A rotary compressor assembly is provided which effectively reduces the vibration and noise occurring during the operation of the rotary compressor of the assembly. The compressor is fixedly mounted on a supporting plate. Vibration dampening members are received in corresponding supporting holes in the plate and serve to support the plate in spaced relation to an installation surface. The geometric center of the supporting holes is disposed so as to coincide with the center of gravity of the rotary compressor including an associated accumulator. As a result, the load is uniformly applied to each dampening member, and the rotary compressor is supported in a stable manner, thereby effectively reducing the vibration and noise associated with compressor operation.

8 Claims, 2 Drawing Sheets

ROTARY COMPRESSOR ASSEMBLY WITH IMPROVED VIBRATION SUPPRESSION

BACKGROUND OF THE INVENTION

1) Field of the Invention

The present invention relates to rotary compressor assemblies and, more particularly, to a rotary compressor assembly of the type including a supporting plate for supporting a rotary compressor on which an accumulator is mounted.

2) Description of Related Art

Generally speaking, a rotary compressor assembly is used to compress a refrigerant to high temperature and high pressure and to discharge the same, in a cooling cycle of an air conditioner, or the like, in which compression, condensation, expansion and evaporation stages are carried out.

A conventional rotary compressor assembly includes an airtight container including a driving motor and a compressing device or compressor therein, and an accumulator for supplying an evaporated refrigerant to the airtight container. The accumulator is contained in a cylindrical casing and communicates with the airtight container through a refrigerant pipe or conduit. A holder or bracket is used to mount the accumulator vertically on an outer wall of the airtight container, eccentrically with respect to axis of the container.

In order to fixedly mount the rotary compressor including the accumulator, a supporting plate is fixed to the underside of the airtight container by welding. More specifically, the rotary compressor is welded onto a center portion of the supporting plate, and supporting holes, into which rubber vibration isolating elements or dampening members are inserted, are formed at angular points of the supporting plate. Each isolating member has a through-hole extending along the central axis thereof, through which a bolt penetrates. With this arrangement, with the isolating elements inserted into the respective supporting holes of the supporting plate and the bolts fastened to a base plate, or other installation surface, of an air conditioner, or the like, through the vibration isolating members, the rotary compressor is fixed in place on, while being vibration isolated against from, the base plate.

A disadvantage of the above-described conventional rotary compressor assembly is that substantial vibration and noise occur during the operation of the driving motor and the compressing device in the airtight container and such vibration is directly transmitted to the base plate. This has a deleterious affect on other parts, significantly shortening the life of these parts. In addition, although the rubber vibration isolating elements are mounted at angular points of the supporting plate, because the rotary compressor is disposed on the supporting plate without regard to the weight of the accumulator attached eccentrically to the rotary compressor, the load is unevenly applied to the respective vibration isolating members. This limits the vibration and noise suppression provided.

SUMMARY OF THE INVENTION

The present invention is concerned with solving the problems discussed above and, to this end, it is an object of the present invention to provide a rotary compressor assembly in which the center of gravity of a rotary compressor, including an accumulator, is correspondingly disposed at the geometric center of a supporting plate for the compressor and accumulator so as to effectively reduce the vibration and noise occurring during the operation of the rotary compressor.

To achieve the above object, a rotary compressor assembly is provided which includes a rotary compressor, an accumulator mounted on an outer wall surface of the rotary compressor, a supporting plate on which the rotary compressor is fixedly mounted, a plurality of supporting holes which are formed on edge portions of the supporting plate, and a plurality of vibration isolating or dampening members received in the supporting holes so as to support the supporting plate in spaced relation to an installation surface, the center of gravity of the rotary compressor including the accumulator being located on the supporting plate in a predetermined relation to the geometric center of the supporting holes such that a uniform load is exerted on each of the vibration isolating members.

Preferably, the center of gravity of the rotary compressor including the accumulator and the geometric center of the supporting holes are disposed so as to coincide with each other on the supporting plate.

Advantageously, the supporting plate has a polygonal shape, and the supporting holes are formed in the vicinity of the respective apexes of the supporting plate. Preferably, the supporting plate has a triangular shape.

In an advantageous implementation, the accumulator is located on a line which connects the center of gravity of the rotary compressor including the accumulator to the apex of the supporting plate.

Further features and advantages of the present invention will be set forth in, or apparent from, the detailed description of preferred embodiments thereof which follows.

BRIEF DESCRIPTION OF THE DRAWINGS

The accompanying drawings, which are incorporated in and constitute a part of the specification, illustrate a preferred embodiment of the invention, and, together with the description, serve to explain the principles of the invention.

DETAILED DESCRIPTION OF PREFERRED EMBODIMENTS

Figure 1:
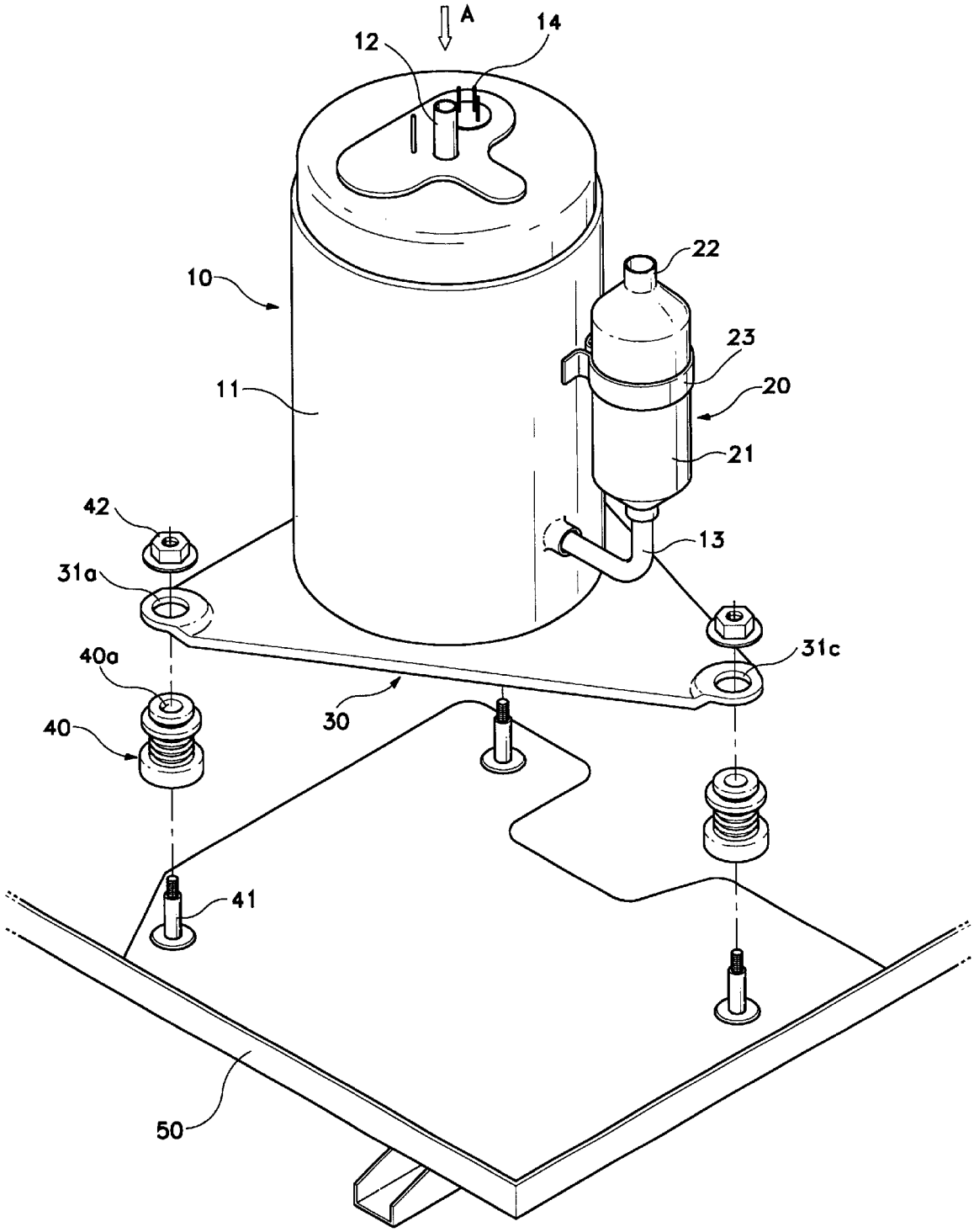
FIG. 1 is a perspective view of a rotary compressor assembly according to a preferred embodiment of the present invention.

A preferred embodiment of the present invention will now be described in detail with reference to the accompanying drawings. Referring to FIG. 1, a rotary compressor assembly is shown which comprises a rotary compressor 10 including an accumulator 20, a supporting plate 30 for supporting the rotary compressor 10, and a plurality of vibration isolating or dampening members 40.

The rotary compressor 10 includes a cylindrical airtight container 11 to which a refrigerant supply pipe 13 and a discharge pipe 12 are coupled for providing intake and discharge of the refrigerant. The accumulator 20 is mounted vertically on an outer wall surface of the airtight container 11. From the upper surface of the airtight container 11, the discharge pipe 12 extends straight upwardly, as illustrated. An electrical input terminal 14 is installed on this upper surface and is supplied with electric power from an external source. A drive motor (not shown) powered from electrical terminal 14 and a compressing device or compressor (not shown) driven by the motor are provided inside of the airtight container 11.

The accumulator 20 includes a cylindrical housing or casing 21, and is fixedly mounted on an outer wall surface of the airtight container 11 by means of a holder or bracket 23.

With the arrangement illustrated, any refrigerant which is not totally vaporized or evaporated in an evaporator (not shown) during the cooling cycle, flows into the accumulator 20 so as to completely evaporated therein, and the evaporated refrigerant flows into the airtight container 11 of the rotary compressor 10 through the refrigerant supply pipe 13. To achieve this, the opposite ends of the supply pipe 13 are connected respectively to an outlet in the lower surface of the casing 21 of the accumulator 20 and to an outlet in the lower side-wall of the airtight container 11. An inlet 22 through which the refrigerant is supplied to the accumulator 20 from the evaporator (not shown) is provided at the upper surface of the casing 21.

Figure 2:
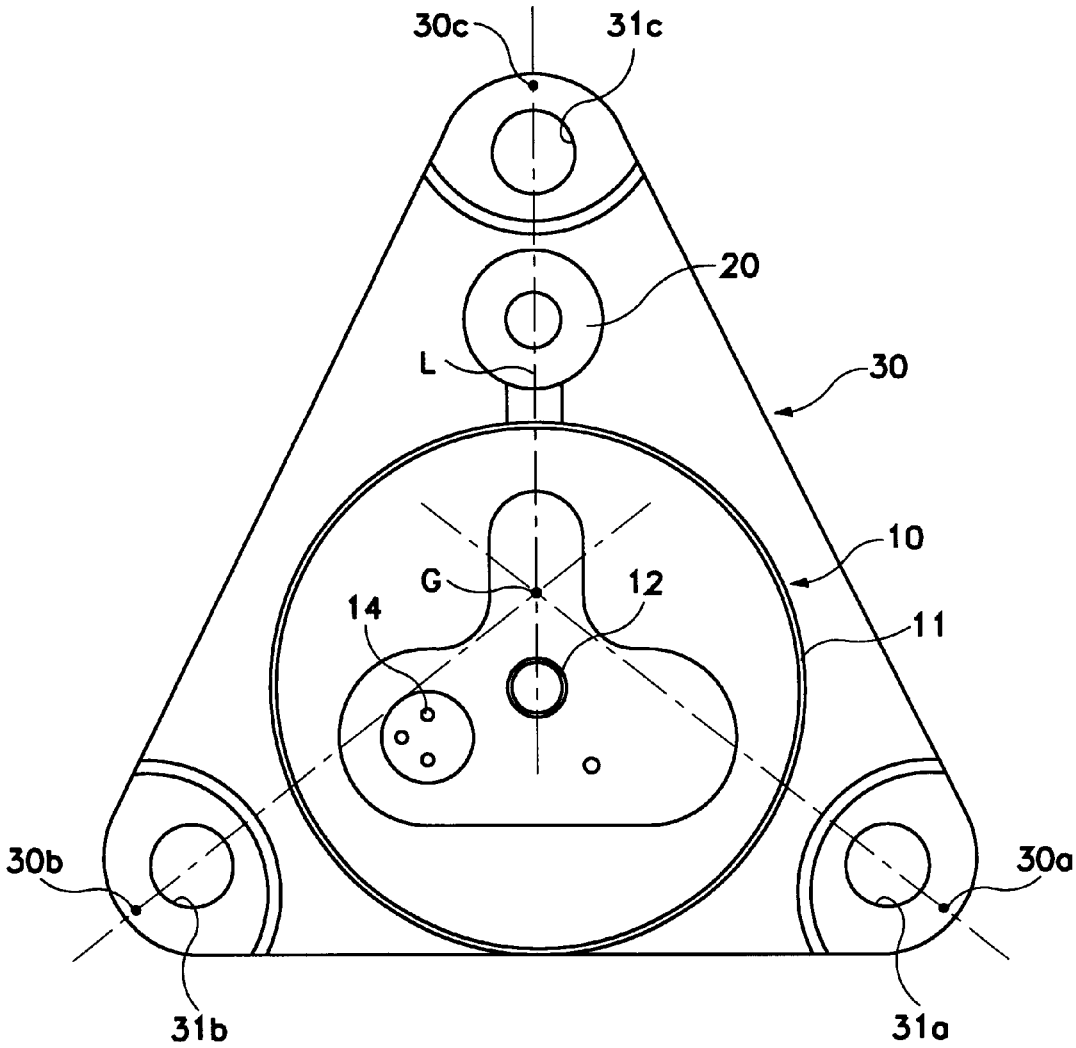
FIG. 2 is a plan view of the rotary compressor assembly of FIG. 1, as viewed in the direction indicated by arrow A in FIG. 1.

The supporting plate 30 supports the rotary compressor 10 in upwardly spaced relation to an installation surface 50, e.g., a base plate of an air conditioner, or the like. As shown in FIGS. 1 and 2, the supporting plate 30 is of a generally triangular shape. The airtight container 11 of the rotary compressor 10 is mounted on and affixed to a center portion of the supporting plate 30, preferably by welding. In addition, a plurality of supporting holes 31*a, 31b and 31c* are provided which have predetermined diameters for receiving the vibration dampening members 40 and which are located in the vicinity of the three respective apexes 30*a*, 30*b* and 30*c* of the triangular supporting plate 30. Each vibration dampening member 40 is made from rubber material and includes a central perpendicular through-hole 40*a*.

When the vibration dampening members 40 are inserted into the respective supporting holes 31*a*, 31*b* and 31*c*, corresponding mounting bolts 41, installed on the installation surface 50 and extending upwardly therefrom penetrate through the respective through-holes 40*a* of the members 40. Nuts 42 are then fastened onto the bolts 41, thereby mounting the triangular supporting plate 30 and thus the airtight container 11 of the rotary compressor 10 in spaced relation to the installation surface 50.

In order to effectively reduce the vibration and noise occurring during the operation of the rotary compressor 10, the geometric center of the supporting holes 31*a*, 31*b* and 31*c* and the center of gravity G of the rotary compressor 10 including the accumulator 20, are disposed so as to substantially coincide with respect to each other on the triangular supporting plate 30. More specifically, as shown in FIG. 2, the accumulator 20 is located on a line L connecting the center of gravity G of the rotary compressor 10, including the accumulator 20, to the apex 30*c* of the triangular supporting plate 30, and thus the center of gravity G of the rotary compressor 10, including the accumulator 20, is identical with the geometric center of the supporting holes 31*a*, 31*b* and 31*c* of the triangular supporting plate 30. Accordingly, the vibration dampening members 40 have a uniform load exerted thereon and provide uniform support for the rotary compressor 10.

The operation of the rotary compressor assembly of the present invention will now be described. The rotary compressor 10 begins operation upon being supplied with electric power. The refrigerant vaporized or evaporated in the evaporator (not shown) flows into the airtight container 11 via the accumulator 20 and the refrigerant supply pipe 13. The refrigerant is then compressed at high temperature and high pressure, and supplied to the cooling cycle through the discharge pipe 12, in a repeated or cyclic operation. At this time, the accumulator 20 prevents unsaturated refrigerant from flowing directly into the airtight container 11. In other words, the refrigerant vaporized or evaporated in the evaporator (not shown) is supplied to the accumulator 20 through inlet 22, and any liquid refrigerant which is not completely vaporized or evaporated is vaporized in the housing or casing 21 and exhausted or discharged into the airtight container 11 through the supply pipe 13.

It is also noted that because the triangular supporting plate 30, on which the rotary compressor 10 is mounted, is supported in spaced relation to the installation surface 50 by the three rubber vibration dampening members 40, vibration occurring during the operation of the compressor 10 is effectively isolated, i.e., is prevented from being transmitted to the surroundings through the installation surface 50. In addition, because the rotary compressor 10, including the accumulator 20, is disposed on the triangular supporting plate 30 with reference to the center of gravity G thereof, each vibration isolating member 40 supports the rotary compressor 10 in a stable manner. As a result, the load exerted by the rotary compressor 10 is uniformly applied to each member 40, so vibration and noise occurring during the operation of the rotary compressor 10 is effectively further reduced.

It will be appreciated that the supporting plate can be of a different polygonal shape, than that shown, i.e., the supporting plate can be a rectangular plate rather than the triangular supporting plate illustrated.

As described above in some detail, according to a preferred embodiment of the present invention, the geometric center of the plurality of supporting holes formed in the supporting plate (into which the vibration isolating or dampening members are inserted) is disposed so as to coincide with the center of gravity of the compressor unit comprising the rotary compressor including the accumulator. As a result, the load is applied uniformly to each dampening member provided on the supporting plate, and the rotary compressor is supported in a stable manner, thereby effectively reducing vibration and noise associated with the compression operation.

Although the invention has been described above in relation to preferred embodiments thereof, it will be understood by those skilled in the art that variations and modifications can be effected in these preferred embodiments without departing from the scope and spirit of the invention.

What is claimed is:

1. A rotary compressor assembly including a rotary compressor, an accumulator mounted on an outer wall surface of the rotary compressor, a supporting plate on which the rotary compressor is fixedly mounted, a plurality of supporting holes formed in edge portions of the supporting plate, and a plurality of vibration dampening members received in the supporting holes so as to support the supporting plate in spaced relation to an installation surface, the supporting holes having a geometric center, the rotary compressor including the accumulator having a center of gravity and said center of gravity being located on the supporting plate in a predetermined relation to the geometric center of the supporting holes such that a uniform load is exerted on each of said vibration dampening members.

2. A rotary compressor assembly as claimed in claim 1, wherein the center of gravity of the rotary compressor including the accumulator and the geometric center of the supporting holes are disposed so as to substantially coincide with each other on the supporting plate.

3. A rotary compressor assembly as claimed in claim 1, wherein the supporting plate has a polygonal shape defining a plurality of apexes, and the supporting holes are each formed in the vicinity of a respective one of the apexes of the supporting plate.

4. A rotary compressor assembly as claimed in claim 3, wherein the supporting plate has a triangular shape.

5. A rotary compressor assembly as claimed in claim 4, wherein the accumulator is located on a line connecting the center of gravity of the compressor unit to one apex of the supporting plate.

6. A rotary compressor assembly as claimed in claim 3, wherein the supporting plate has a triangular shape.

7. A rotary compressor assembly as claimed in claim 4, wherein the accumulator is located on a line connecting the center of gravity of the rotary compressor including the accumulator to one apex of the supporting plate.

8. A rotary compressor assembly comprising:

a compressor unit having a center of gravity and comprising a rotary compressor and an accumulator mounted on the compressor;

a supporting plate on which said compressor unit is mounted, said plate being of a polygonal shape including a plurality of apexes formed at the intersection of adjacent sides, said plate including a plurality of supporting holes having a geometric center, and each of said supporting holes being located substantially at a respective apex of the plate; and a plurality of vibration dampening members for supporting said plate in spaced relation to a support surface, each of said vibration dampening members being received in a respective supporting hole and the center of gravity of said compressor unit coinciding with the geometric center of said supporting holes.

* * * * *